US012667171B2

(12) United States Patent
Alsubaie et al.

(10) Patent No.: US 12,667,171 B2
(45) Date of Patent: Jun. 30, 2026

(54) WEARABLE UMBRELLA

(71) Applicants: Abdullatif Alsubaie, Mekkah (SA); Youssif Alsubaie, Mekkah (SA)

(72) Inventors: Abdullatif Alsubaie, Mekkah (SA); Youssif Alsubaie, Mekkah (SA)

( * ) Notice: Subject to any disclaimer, the term of this patent is extended or adjusted under 35 U.S.C. 154(b) by 48 days.

(21) Appl. No.: 18/716,874

(22) PCT Filed: Feb. 26, 2023

(86) PCT No.: PCT/SA2023/050004

§ 371 (c)(1),
(2) Date: Jun. 5, 2024

(87) PCT Pub. No.: WO2023/204735

PCT Pub. Date: Oct. 26, 2023

(65) Prior Publication Data

US 2025/0040671 A1 Feb. 6, 2025

(51) Int. Cl.

| | |
|---|---|
| ***A45B 11/02*** | (2006.01) |
| ***A45B 25/02*** | (2006.01) |
| ***A45F 3/00*** | (2006.01) |

(52) U.S. Cl.

CPC ..... *A45B 11/02* (2013.01); *A45B 25/02* (2013.01); *A45F 3/00* (2013.01); *A45F 2003/007* (2013.01)

(58) Field of Classification Search

CPC ..... A45B 11/02; A45B 2023/0093; A45B 2200/1009; A45F 3/04; A45F 2003/003

See application file for complete search history.

(56) References Cited

U.S. PATENT DOCUMENTS

| | | | | |
|---|---|---|---|---|
| 1,803,538 | A * | 5/1931 | Pistole | A45B 11/02 224/189 |
| 2,434,526 | A * | 1/1948 | Thornton | A45B 11/02 224/189 |
| 8,944,300 | B1 | 2/2015 | Kaufman | |
| 9,907,370 | B2 * | 3/2018 | Huddleston | A45B 11/02 |
| 10,376,069 | B2 | 8/2019 | Scrone-Smith | |
| 10,835,004 | B2 | 11/2020 | Scrone-Smith | |
| 2005/0279396 | A1 * | 12/2005 | Choi | A45B 11/04 135/133 |
| 2010/0313922 | A1 | 12/2010 | Raider | |
| 2013/0270312 | A1 * | 10/2013 | Yun | A45F 5/00 224/268 |
| 2018/0192776 | A1 | 7/2018 | Scrone-Smith | |

(Continued)

FOREIGN PATENT DOCUMENTS

| | | |
|---|---|---|
| CN | 204306203 U | 5/2015 |
| CN | 205512835 U | 8/2016 |
| CN | 209376895 U | 9/2019 |

(Continued)

*Primary Examiner* — Corey N Skurdal
(74) *Attorney, Agent, or Firm* — Maschoff Brennan

(57) ABSTRACT

A wearable umbrella comprising a fabric cloth stretched over a hand-foldable flexible plastic frame, and provided with a flexible plastic support member pivotally attached to the frame, and snaps to it, and they are folded together in a circular shape, so that the umbrella is installed securely, and the lower portion of the support is attached with a plurality of belts to balance the umbrella and distribute its weight, to secure the umbrella on the user's body during usage. The umbrella also includes a fabric pocket, and a bag to store the umbrella when folded.

3 Claims, 4 Drawing Sheets

(56) References Cited

U.S. PATENT DOCUMENTS

| | | | |
|---|---|---|---|
| 2019/0307254 | A1 | 10/2019 | Scrone-Smith |
| 2021/0022511 | A1 | 1/2021 | Scrone-Smith |

FOREIGN PATENT DOCUMENTS

| | | | |
|---|---|---|---|
| CN | 212185470 | U | 12/2020 |
| EG | 2011030332 | A | 3/2011 |
| JP | 2003310320 | | 11/2003 |
| JP | 2012255243 | A | 12/2012 |
| KR | 20110002393 | U | 3/2011 |
| KR | 1020200002207 | A | 1/2020 |
| KR | 20220111124 | A | 8/2022 |
| TW | M502368 | U | 6/2015 |

* cited by examiner

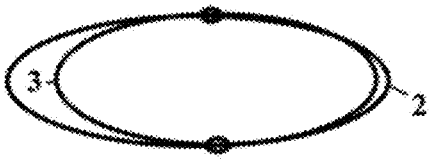
Figure 3-a
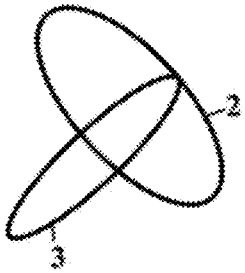
Figure 3-b

WEARABLE UMBRELLA

BACKGROUND

The present invention relates to a wearable umbrella. More specifically, the present invention relates to a wearable and easy to fold umbrella.

Many people need to use an umbrella to protect them from the heat of sun, especially operators who work in open sites such as construction sites, and even while walking in very hot places such as deserts or when performing the rituals of Hajj and Umrah. Working or even just walking in the sun for long periods of time is exhausting and can have very harmful effects. Therefore, in most cases, people carry an umbrella to avoid the heat of the sun.

The traditional umbrella is a structure comprising a plurality of steel or plastic arms attached to a pivotal arm which is carried by hand. These arms are covered by the umbrella fabric, and different materials have been used in the manufacture of the umbrella fabric, some of which are water proof, and others are not water proof. However, such a traditional umbrella may hinder manual work, as the user has to use one hand to carry the umbrella, and it may burden the person as a result of its weight and instability.

Therefore, in prior art, there are multiple attempts to provide an umbrella that protects from the sun's heat and does not need to be carried by hand. For example, a type of umbrella has been developed which is worn on the head by means of a plurality of belts that wrap around the user's head, so that it is equipped with two arms that carry the body of the umbrella. Also, types of umbrellas that are worn on the back or shoulder have been developed. For example, KR20200002207 discloses a wearable umbrella intended to allow the use of both hands while wearing the umbrella. The umbrella comprising umbrella body including many steel wires for folding the umbrella, the umbrella fabric includes many triangular fabrics to protect from rain or snow, umbrella stand is a long stick shape to support umbrella fabric, the umbrella is fixed on shoulders by a plurality of belts.

However, the expert in the art finds that the shape of the above-mentioned umbrella body is the traditional shape of an umbrella divided by steel wires into triangular parts, and the structure of the umbrella is based on steel wires. Although the aforementioned umbrella may contribute to liberating the hands and distributing the weight of the umbrella on the shoulders, the mentioned umbrella still does not provide comfort due to the steel wires, and it also makes a burden on the user when not wearing it, wherein it is folded in the traditional way, which depends on joining steel wires internally to fold the triangular parts of the umbrella fabric inward. The user remains obliged to carry it with his hands after that.

Also, JP2003310320 discloses an umbrella that features two poles that are installed together on the shoulder area opposite the right and left of the user's head. Compared to the traditional single-structure umbrella, the umbrella mentioned in the Japanese patent application is more stable than the traditional single-pole umbrella. Since such umbrella increases the feeling of unity with the human body and ensures freedom of movement for the upper limbs. Since the weight of the umbrella body is carried by the saddle-shaped plastic parts on the shoulder, the weight of the umbrella is reduced and distributed to the right and left. However, the problem of folding the umbrella mentioned above still exists in this umbrella as well, in addition to the burden of carrying the umbrella when not in use. The structure of the umbrella is also a plurality of wires that are attached to two arms, so that the arms are pulled inward to fold the umbrella fabric, which makes wearing and folding this umbrella a tedious and uncomfortable process for daily use.

Accordingly, there is still a need to provide an umbrella which is easy to fold, small in size, and light in weight and can be worn in both cases, whether when in use or after being folded to free hands, whether when using the umbrella or when not in use.

SUMMARY OF INVENTION

In light of the technical problem mentioned above, the present invention aims to provide an umbrella which is easy to fold, wearable on the shoulders, light in weight, and small in size, which is placed in its own bag when folded, so that the umbrella is carried on the shoulders while it is opened, while it is kept in its bag and carry the bag over the shoulder when not in use. In order to achieve the aim of the above invention, the umbrella according to the present invention comprises a cloth fabric that has been stretched on a hand-foldable flexible plastic frame, and the umbrella frame is provided with a flexible plastic support member. It fits on the umbrella frame, and is pushed into the middle of the umbrella fabric when the umbrella is opened to support the umbrella fabric, so that the upper portion of the support member is centered on the umbrella fabric when opened, and the lower portion rests on the front of the user's body, so that the umbrella is securely installed. The lower portion of the support member is also connected to a belt which is passed behind the user's neck so that it rests on the user's shoulder to distribute the weight of the umbrella, and to fix the umbrella in its position, and a belt that wraps around the chest area.

The umbrella includes a fabric pocket located in the front of the umbrella that can be used to store personal items while using the umbrella. The umbrella is also provided with a cloth bag in which the umbrella can be placed in a cloth bag and carried on the shoulder when the umbrella is not in use.

The umbrella, according to the current invention, is distinguished by the presence of a pair of belts that are placed on the shoulder and wrapped around the chest, distributing the weight and becoming light, in addition to that it does not cover the face or the back to allow air to pass through while blocking the sun.

Figure 1:
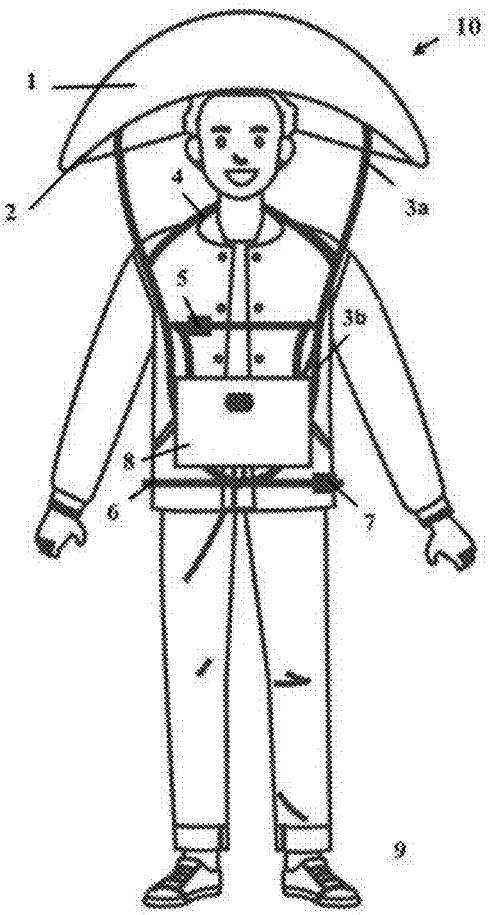
FIG. 1: a front view of the wearable umbrella during use according to the present invention.
Figure 2:
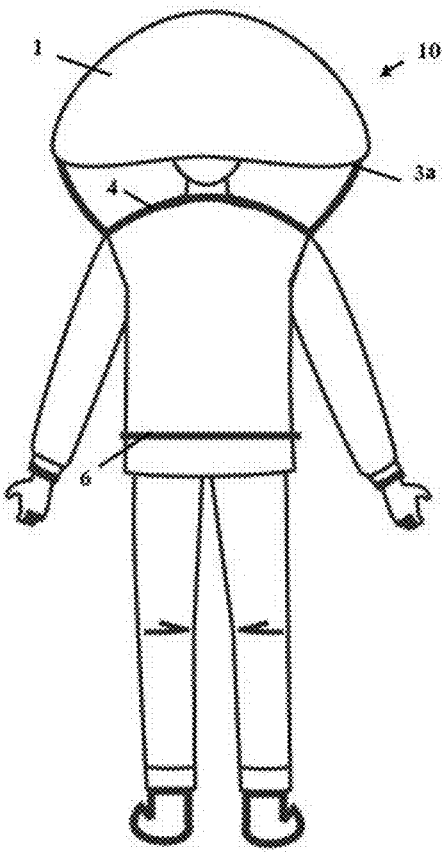
FIG. 2: a rear view of the wearable umbrella during use according to the present invention.

FIG. (3-*a*): shows the flexible frame of the umbrella attached to the support member pivotally, in the event that the support member snaps to the frame before it is pushed up.

FIG. (3-*b*): shows the flexible frame of the umbrella attached to the support member pivotally, after pushing the support member to secure the umbrella.

FIG. (4): a perspective drawing showing the umbrella in the case of being folded and placed in its bag.

DETAILED DESCRIPTION

Referring to FIGS. (1) and (2), an umbrella (10) is shown comprising a cloth fabric (1) that was stretched on a hand-foldable flexible plastic frame (2), and the umbrella frame was provided with a flexible plastic support member (3). It is applicable to the umbrella frame as shown in FIG. (3-*a*), and perpendicular to the frame when pushed to mediate the umbrella fabric when the umbrella is opened to support the umbrella fabric as shown in FIG. (3-*b*), so that the upper portion (3*a*) of the support member mediates the fabric When the umbrella is opened, the lower portion (3*b*) rests on the front of the user's body, so that the umbrella is securely installed. The lower portion (3*b*) of the support member is also connected to a plurality of belts to balance the umbrella and distribute its weight. The shoulder belt (4) is passed behind the user's neck to rest on the user's shoulder to distribute the weight of the umbrella, and to fix the umbrella in its position, and the chest belt (5). The support member is also attached to a waist belt (6), it has a clip (7) to secure the umbrella to the user's body during use.

Figure 4:
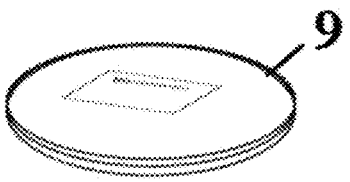

The umbrella includes a fabric pocket (8) located in the front of the umbrella, which can be used to store personal items while using the umbrella. The umbrella was also provided with a bag (9) of cloth in which the umbrella can be placed and carried on the shoulder when the umbrella is not used, as the umbrella takes a circular shape when folded as shown in FIG. 4).

As shown in FIGS. (3-*a*) and (3-*b*), the structure of the umbrella that distinguishes the umbrella of the present invention is evident, as it is a plastic frame (2) that includes a flexible plastic support member (3) which is pivotally attached to the frame (2), so that the support member snaps into the frame, and is pushed to center the umbrella fabric when the umbrella is opened. It is then pulled to snap onto the frame again, folding them together into a circular shape.

The invention claimed is:

1. A wearable umbrella (10) comprising:

a cloth fabric (1) stretched on a hand-foldable flexible plastic frame (2), a flexible plastic support member (3) pivotally attached to the frame (2), the support member (3) having an upper portion (3*a*) configured to engage a central region of the fabric (1) when the umbrella is opened and a lower portion (3*b*) configured to rest against the front of the user's body to stabilize the umbrella;

wherein, in a folded state, the plastic support member (3) is snapped into the hand-foldable flexible plastic frame (2) such that the support member (3) and the frame (2) fold together into a generally circular shape;

wherein in an opened state, the support member (3) is oriented substantially perpendicular to the frame (2) so that the upper portion (3*a*) urges the fabric (1) upward; and wherein the lower portion (3*b*) is coupled to a plurality of belts to balance the umbrella and distribute its weight, the plurality of belts including a shoulder belt (4) passing behind the user's neck to rest on the user's shoulder to distribute the weight of the umbrella, and to fix the umbrella in its position, and a chest belt (5), and a waist belt (6), containing a clip (7) to secure the umbrella to the user's body during use.

2. The wearable umbrella according to claim 1, wherein the umbrella includes a cloth pocket (8) located in the front of the umbrella to store personal items while using the umbrella.

3. The wearable umbrella according to claim 1, wherein the umbrella was provided with a bag (9) of cloth in which the umbrella is placed and carried on the shoulder when the umbrella is not used, since the umbrella takes a circular shape when folded.

* * * * *